US006860820B2

(12) United States Patent
Specht

(10) Patent No.: US 6,860,820 B2
(45) Date of Patent: Mar. 1, 2005

(54) GOLF CLUB AND METHODS OF MANUFACTURE

(75) Inventor: Paul Specht, Wilmette, IL (US)

(73) Assignee: Chapel Golf, Inc., North Palm Beach, FL (US)

( * ) Notice: Subject to any disclaimer, the term of this patent is extended or adjusted under 35 U.S.C. 154(b) by 0 days.

(21) Appl. No.: 10/720,936

(22) Filed: Nov. 24, 2003

(65) Prior Publication Data

US 2004/0116199 A1 Jun. 17, 2004

Related U.S. Application Data

(63) Continuation-in-part of application No. 10/218,886, filed on Aug. 14, 2002, now Pat. No. 6,692,376.

(51) Int. Cl.[7] ..... A63B 53/04

(52) U.S. Cl. ..... 473/312; 473/341; 473/342; 473/350

(58) Field of Search ..... 473/304, 311–314, 473/340–342, 346–349, 350

(56) References Cited

U.S. PATENT DOCUMENTS

| | | | |
|---|---|---|---|
| 1,319,802 | A | 10/1919 | Shea |
| 3,042,405 | A | 7/1962 | Solheim |
| 3,220,733 | A | 11/1965 | Saleeby |
| 3,387,844 | A | 6/1968 | Shippee |
| 3,516,674 | A | 6/1970 | Scarborough |
| 3,873,090 | A | 3/1975 | Thompson |
| 4,063,733 | A | 12/1977 | Benedict |
| 4,113,249 | A | 9/1978 | Beery |
| 4,128,244 | A | 12/1978 | Duclos |
| 4,162,074 | A | 7/1979 | Thomson |
| 4,444,395 | A | 4/1984 | Reiss |
| 4,521,022 | A | 6/1985 | Schmidt |
| 4,630,827 | A | 12/1986 | Yoneyama |
| 4,697,814 | A | 10/1987 | Yamada |
| 4,793,616 | A | 12/1988 | Fernandez |
| 4,912,830 | A | 4/1990 | Vesligaj |
| 4,915,385 | A | 4/1990 | Anderson |
| 4,979,744 | A | 12/1990 | Alcala |
| 5,004,242 | A | 4/1991 | Iwanaga et al. |
| 5,090,698 | A | 2/1992 | Kleinfelter |
| 5,127,653 | A | 7/1992 | Nelson |

(List continued on next page.)

FOREIGN PATENT DOCUMENTS

| | | |
|---|---|---|
| EP | 0 965 366 A1 | 12/1999 |
| FR | 2523854 A | 9/1983 |
| GB | 2309390 A | 7/1997 |
| GB | 2336123 A | 10/1999 |
| TW | 362523 A | 6/1999 |
| WO | WO 99/24124 A | 5/1999 |
| WO | WO 01/10513 A | 2/2001 |
| WO | WO 01/74457 A | 10/2001 |

OTHER PUBLICATIONS

Patent Abstracts of Japan, vol. 018. No. 451, regarding Japanese Patent Publication JP–A–6–142240 (Kurien K.K.) (Aug. 23, 1994).

*Primary Examiner*—Stephen Blau
(74) *Attorney, Agent, or Firm*—Leydig, Voit & Mayer, Ltd

(57) ABSTRACT

Golf putters having enhanced balance and sensory feedback and improved manufacturing methods therefor. The putters include: a shaft; a hosel and a body in an integrated unit of relatively low mass density; an armature extending through the assembly and into the shaft; and, a shell of relatively high mass density having polar toe and heel portions and a web between the toe and heel portions, the armature extending up from the web connecting the shell, the integrated body and hosel and the shaft. The manufacturing methods include unique shells and integrated assemblies and enhanced assembly methods therefor.

39 Claims, 8 Drawing Sheets

U.S. PATENT DOCUMENTS 5,137,275 A 8/1992 Nelson
5,277,866 A 1/1994 Wright
5,308,067 A 5/1994 Cook
5,308,068 A 5/1994 Strand
5,342,812 A 8/1994 Niskanen et al.
5,382,019 A 1/1995 Sneed
5,388,827 A 2/1995 Reynolds, Jr.
5,501,461 A 3/1996 Donofrio
5,536,011 A 7/1996 Gutowski
5,558,332 A 9/1996 Cook
5,797,176 A 8/1998 Rose et al.
5,842,935 A 12/1998 Nelson
5,938,543 A 8/1999 McGeeney et al.
6,083,115 A 7/2000 King
6,095,931 A 8/2000 Hettinger et al.
6,328,662 B1 12/2001 Huang
6,344,002 B1 2/2002 Kajita
2001/0029209 A1 10/2001 Kosovac

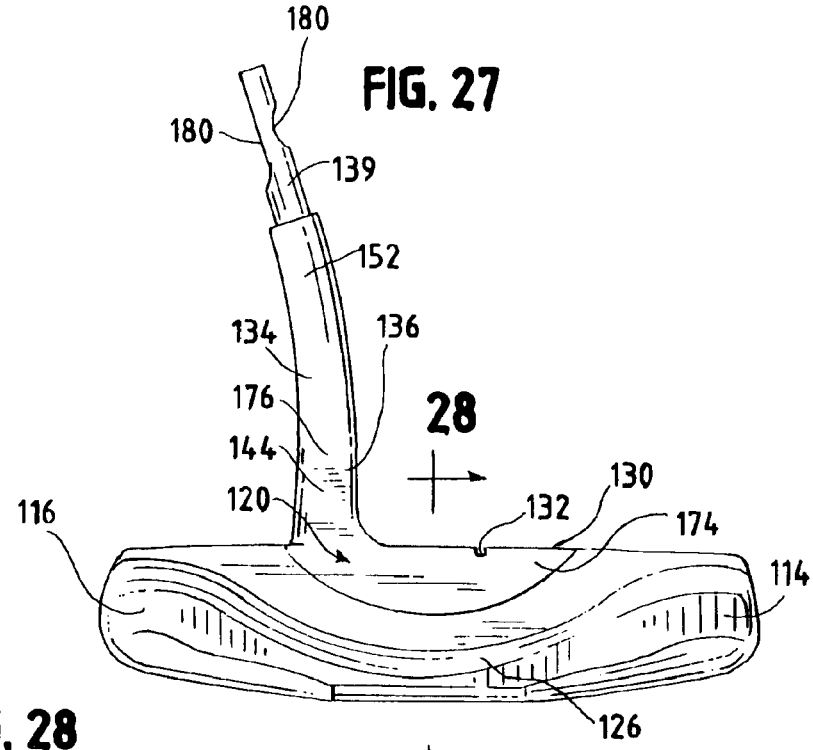
FIG. 27
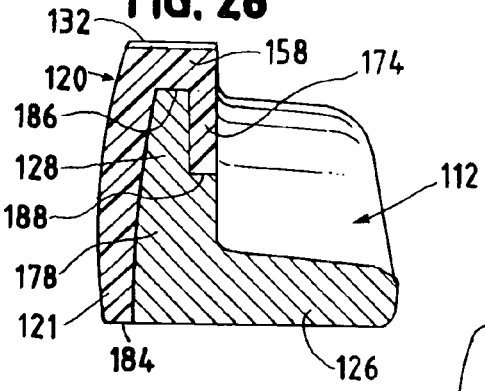
FIG. 28
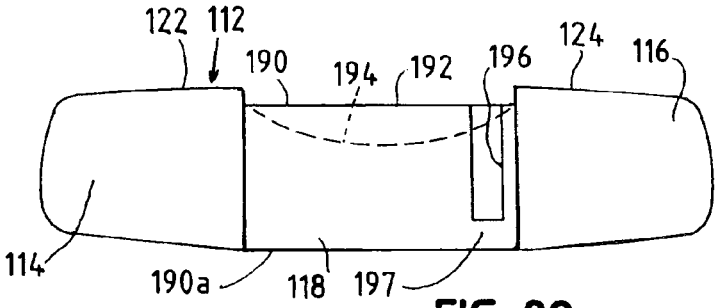
FIG. 29
FIG. 30
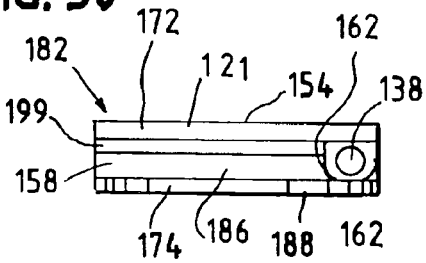

GOLF CLUB AND METHODS OF MANUFACTURE

REFERENCE TO RELATED PATENT APPLICATIONS

This patent application is a continuation-in-part of U.S. patent application Ser. No. 10/218,886, filed Aug. 14, 2002 now U.S. Pat. No. 6,692,376.

FIELD OF THE INVENTION

The present invention relates to the field of golf clubs, and more particularly, to golf putters having enhanced balance and sensory feedback and to improved manufacturing methods therefor.

BACKGROUND OF THE INVENTION

The golf club art has seen substantial creative work in clubhead mass distribution, clubhead configuration, audible and sensory feedback and the like. Much has been done in golf putter design in an effort to improve the performance of the golfer or otherwise enhance the golfing experience. U.S. Pat. No. 3,042,405 to Karsten Solheim issued on Jul. 3, 1962 and discloses a golf putter having internal weights at the heel and toe ends of the club. The end blocks are connected together by one or two thin face plates and a bar that supports a hosel to produce a ringing sound and a torsion bar effect.

U.S. Pat. No. 4,444,395 to Morton Reiss discloses a putter head having an elongate low mass center section with a length at least 1½ times the ball diameter and two, more massive, end sections for inertial stability. The three sections have substantially the same transverse cross section and are connected together longitudinally. A conventional club shaft is proximally secured to the head.

U.S. Pat. No. 4,979,744 to Alcala also relates to a toe-heel weighted golf putter. Toe and heel weights are mounted on a lightweight frame structure of two thin narrow plates made up of light weight composite material. One plate, the hosel plate that supports a light weight hosel, is slotted behind the face plate to provide a resilient mid-portion for striking the ball.

Another approach to putter shape, size and weight distribution is found in U.S. Pat. No. 5,938,543 to McGeeney et al. where a center portion of the head is of relatively low mass density, non-metallic material. The head has higher density metallic heel and toe portions and all three portions are of substantially uniform depthwise construction joined along transverse faces. Various methods for making the three clubhead portions and joining their transverse faces are described. An integrally formed high density hosel extends upwardly from the heel portion.

Some putters known in the art are said to have an awkward "feel" when striking a golf ball, believed to be in part because of the distribution of weight within the clubhead. In addition, while the prior art has provided other golf clubs that are said to have a proper feel and to be properly balanced, many of these golf clubs are unattractive and the physical appearance is distractive. Some configurations do not provide the optimum perspective to the golfer as the ball is addressed nor provide a satisfactory audible or tactile response as the club strikes the ball. Moreover, the club and clubhead configurations often involve complex manufacturing procedures and costly manufacturing equipment. Thus there exists an ongoing need in the art for a golf putter that has an optimum balance and feel, an appearance and a sighting perspective which support concentration and audible and tactile responses that optimize the relationship between golfer and putter.

General objects of this invention include providing a golf putter that optimizes the foregoing criteria and providing improved and efficient manufacturing methods that enhance and compliment the new product.

In the parent U.S. Pat. No. 6,692,376, referenced in Paragraph [0001] above, a golf putter invention is disclosed that satisfies the need as set forth in Paragraph [0007]. The golf putter set forth herein retains and enhances the benefits of the invention of the '376 patent. Moreover, the instant invention provides product designs and methods of manufacture that improve product quality and performance and lower the cost and complexity of manufacturing.

BRIEF SUMMARY OF THE INVENTION

The general objects of this invention include the creation of improved golf putters of simplified construction adapted for simplified and low cost manufacturing methods. The putters of this invention provide the benefits of the putter disclosed in the '376 patent, including enhanced audible and sensory feedback to the golfer. Golf putters made according to this invention provide superior sensitivity to the stroke and impact, a dynamic sense of balance and an enhanced "feel" which is fed back visually and by tactile sensations indicative of stroke quality. These characteristics of the clubbead are further enhanced from integration of a shaft of low mass density material and the low mass density hosel and body with a shell having high mass density heel and toe polar shell portions and a medial shell portion to receive the body. The low mass density materials are usually non-metallic such as graphite or fiberglass and resin composites while the high mass density materials are usually metals such as steel. An armature extending up from the medial portion, through a combined body and hosel and into the shaft integrates the entire system. The benefits of the unique combined body and hosel, integrated through the armature with the shaft and medial portion, are augmented by the methods of manufacture provided by this invention. The shell and the combined body and hosel are configured to interfit, in cooperation with the armature, to provide simplified fabrication of the component parts and precise assembly of the finished product.

In preferred embodiments of the invention, the clubhead body portion has a striking surface having a cylindrical or roll face configuration the longitudinal axis of which is aligned with the longitudinal axis of the clubhead. The striking surface extends between the body upper surface and a bottom surface that forms a portion of the sole of the club. The striking surface is preferably a cylindrical segment that correlates with a sweet spot and the top and bottom surfaces. For the putting stance of most golfers, this surface minimizes skipping or jumping and causes the ball to hug the green. It is a portion of the striking face of the clubhead.

In one preferred embodiment, a relatively high mass density shell has large polar toe and heel portions with an intermediate medial portion. The medial portion includes a low rear shelf and an upstanding web and defines a forward cavity. A combined body and hosel of low mass density material has a reinforcing armature that extends above the hosel where it integrates the hosel with a shaft of a similar low mass density material. The body is secured in the cavity and a portion of the armature is secured in a recess in the cavity. The body portion is a generally rectilinear blade having a striking surface, a sole surface and a sighting upper surface. The invention provides advantages in blade-type putters with or without a rear shelf and in mallet-type putters having various back configurations. The hosel may be straight or may include a single or double offset portion. The midsection aligns the shaft axis and the striking surface of the clubhead and the upper section establishes a shaft angle of about 72° to the sole, called the "lie" angle.

Other features and objects of the invention will be apparent from the following description of the invention and its embodiments.

BRIEF DESCRIPTION OF THE DRAWINGS

For clarity, the following nomenclature, adapted from the prior art, will be employed in the description. The ball striking surface or "strike face" of the clubhead, which is intended to hit the golf ball, is located on the "front" of the clubhead. The terms "top" or "upper" and "bottom" or "lower" assume that the clubhead is oriented as it would be if the golf club were held by a golfer in an at rest position, i.e., the bottom of the clubhead, also called the sole, would contact the ground when at rest. The heel of the clubhead is located longitudinally opposite the toe of the clubhead. The heel portion of the clubhead would be nearest the golfer when the golfer holds the club in an at rest position. The term "depth" refers to a dimension extending from the front to the back of the golf club. The terms "length" of the clubhead and "longitudinal" refer to dimensions along a line between the heel end and the toe end.

FIG. 27 is a rear elevation of the embodiment of FIG. 21;

FIG. 28 is a sectional view, taken on the line 28—28 of FIG. 27;

FIG. 29 is a front elevation of the shell of the clubhead of FIG. 21; and, FIG. 30 is a bottom view of the body/hosel assembly of FIG. 25.

DETAILED DESCRIPTION OF THE INVENTION

Figure 1:
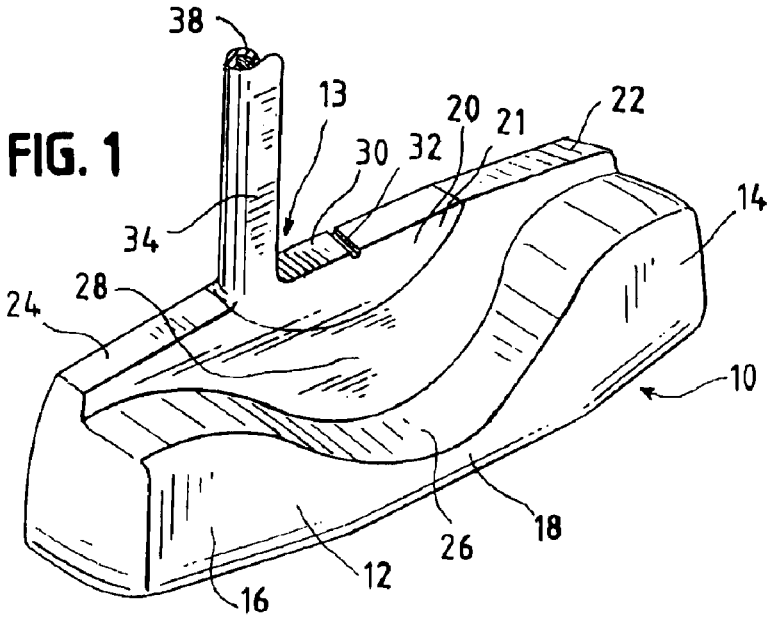
FIG. 1 is perspective view of the clubhead of one embodiment of the invention, partially cut away.

Referring now to the drawings, FIGS. 1–9 show a first embodiment 10 of the golf club of this invention that provides enhanced golfer performance and satisfaction and is manufactured by a simplified and efficient method. The clubhead is manufactured as two component elements that are combined in a simple assembly operation and integrated with a shaft to form the complete club. One of the components of the first embodiment, a combined body and hosel assembly 61 comprising body 20 and hosel 34 is shown in FIGS. 10–16. The second component, a shell 12 is shown in FIGS. 17–20. A second embodiment described herein is shown in FIGS. 21–28.

Figure 2:
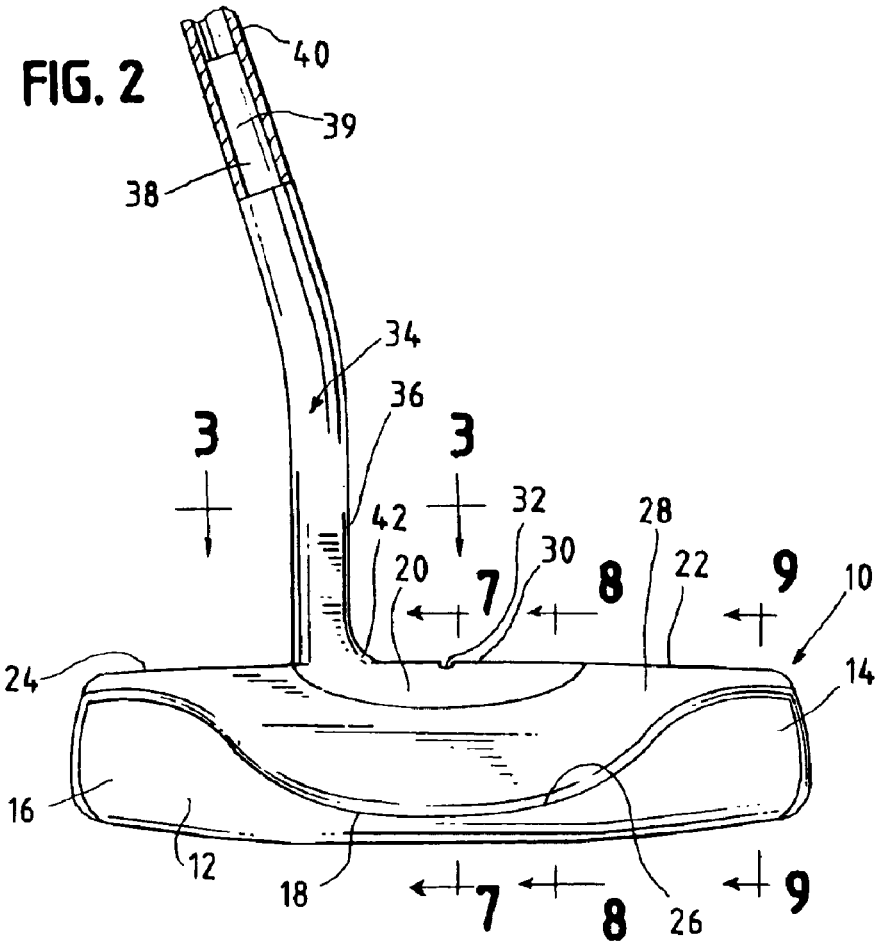
FIG. 2 is a rear elevation of the embodiment of FIG. 1 with a portion of the shaft shown in section.

Referring now to FIGS. 1 and 2, FIG. 1 is a partial perspective backside view of clubhead 10 and shows shell 12 having longitudinally aligned polar toe portion 14 and polar heel portion 16 with a medial portion 18 therebetween. The shell of relatively high mass density material such as steel is configured to provide polar mass concentrations 14 and 16 for inertial stability of the clubhead. In the embodiment of FIG. 1 the shell defines a toe end 22 and heel end 24 of a blade. The medial portion defines a proximal shelf 26 between the polar masses 14 and 16. An insert or body 20 of low mass density material has a striking plate (shown in FIG. 2) secured in a cavity in a forward web 28 of the medial portion 18. An upper portion 21 of body 20 extends rearwardly and, with the striking plate, defines an upper surface 30 aligned with the top surfaces of the toe end 22 and heel end 24 of the putter blade. An alignment indicium comprising a transverse channel 32 is formed in the upper surface 30 above the area on the striking surface defined as the target spot. A hosel 34 is formed integrally with and of the same material as body 20 and extends upwardly from the upper surface 30.

A rigid armature 38 is disposed in the hosel 34 and in the body 20 as will be describe further hereinafter. As shown in FIG. 2, the armature 38 includes a post 39 that extends beyond the top of hosel 34 and is received in and stiffens hollow golf club shaft 40. The shaft 40 is broken away in FIG. 2 for clarity. The shaft is preferably formed of the same low mass density material, such as a graphite or fiberglass and resin composite, used in forming the combined body 20 and hosel 34. The clubhead end 40 is integrated with the hosel as shown in FIG. 2 and the gripping end has a relatively soft grip of leather or the like attached thereto.

Figure 4:
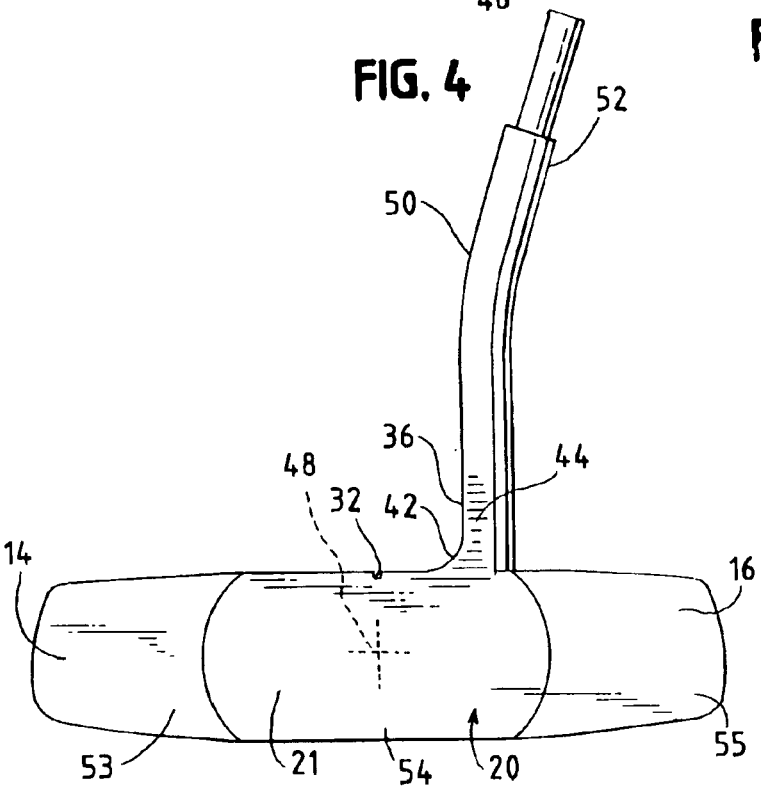
FIG. 4 is a front elevation of the complete clubhead of FIGS. 1–2.
Figure 5:
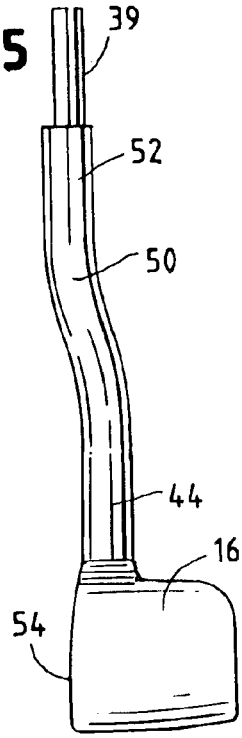
FIG. 5 is a heel end elevation of the clubhead of FIG. 4.

The hosel has a flattened transverse surface 36 facing and aligned with the toe end top surface 22 that defines for the golfer the direction of ball travel and cooperates with the indicia 32 to assist the golfer in alignment and stroking. As best seen in FIGS. 4 and 5, the hosel in this embodiment has three sections, a lower section 44 extending up from the upper surface 30, plus a curved midsection 50 and a sloping upper section 52. The lower section 44 has a concave fillet 42 and flattened front and rear faces 46 that blend with the edges of the upper surface 30.

Figure 3:
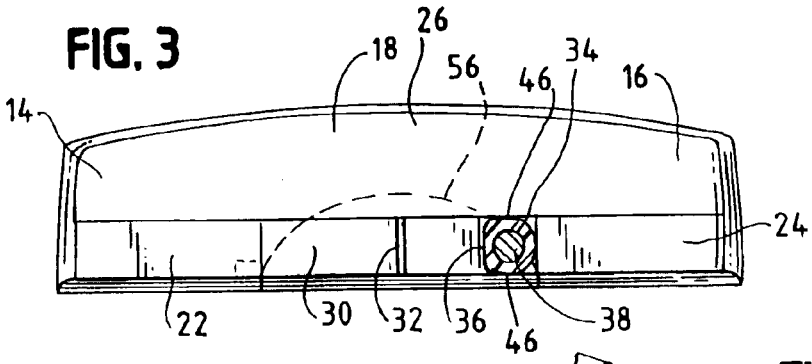
FIG. 3 is a top view of the embodiment of FIG. 2 taken on the section line 3—3 of FIG. 2.

FIG. 3 is a top view of the putter taken on the line 3—3 of FIG. 2. The hosel 34 of low mass density material with the central armature 38 of steel or the like is shown in section for clarity. The top surface of the toe blade 22 and of the heel blade 24 aligned with the upper surface 30 of the body aid the golfer in addressing the ball. The alignment indicium 32 above the optimum target on the striking face provides further visual assistance to the golfer. The medial portion 18 of shell 12 extends rearwardly from the blade to define a shelf 26 and the polar toe portion 14 and heel portion 16 extend behind the blade portions thereof in this embodiment. As already mentioned, there are various clubhead styles including a simple blade, a blade with a rearward shelf, mallets and the like. The invention can be incorporated in various putterf styles and the advantages of the putter configurations and manufacturing methods described herein are attained therein.

The striking surface 53 of the polar toe portion 14 and striking surface 55 of polar heel portion 16 of shell 12 are shown in FIGS. 4 and 5. The striking plate 21 of body 20 is proximally located between the polar portions and in longitudinal alignment. The approximate target position 48 is indicated in broken lines on the striking surface 54 of plate 21. The alignment indicium 32 on the upper surface of body 20 defines the longitudinal position of that target. The hosel is viewed as having three sections, the lower section 44 discussed above, a mid section 50 slanted toward the body striking surface 54 to provide optimum alignment of the club shaft with the striking surface and a top section 52 extending at an angle called the 'lie' angle to accommodate the most popular stance of the golfer when addressing the putt. This angle is usually 72° to the sole and consequently to the surface of the green as the golfer addresses the ball. Also, as shown in FIG. 4 the body striking surface 54 is preferably slightly convex with a center behind the club (to the right in FIG. 5) and slightly below the level of the target 48 to provide a slight loft as the striking surface 54 engages the ball.

Figure 6:
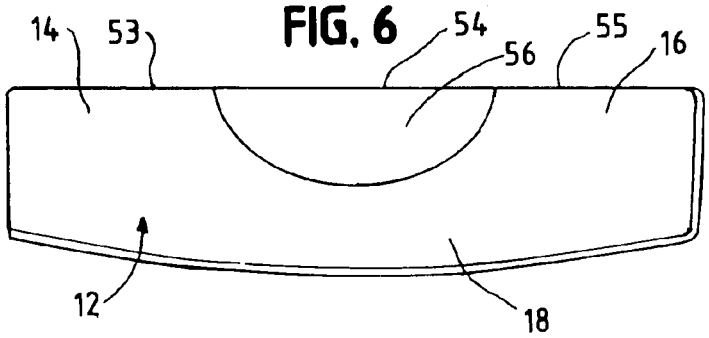
FIG. 6 is a bottom plan view of the embodiment of FIG. 4.

As seen in FIG. 6, the body 20 of FIG. 1 has a sole portion 56 that extends rearwardly from the striking surface 54. The sole portion 56 is embedded in the shell 12 and forms a flush sole surface with the bottom surfaces of the medial portion 18 and the polar portions 14 and 16 of shell 12. The sole portion 56 of inert 20 is shown in broken lines in the top view of the clubhead, FIG. 3.

Figure 7:
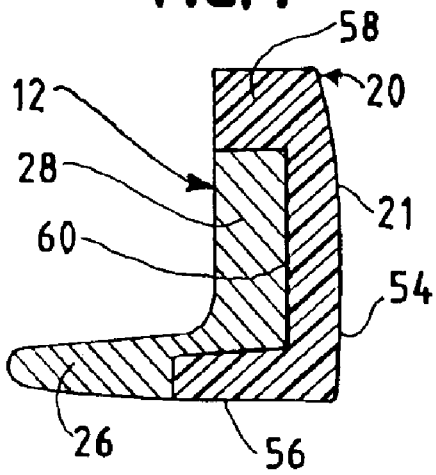
FIG. 7 is a sectional view taken on line 7—7 of FIG. 2.
Figure 8:
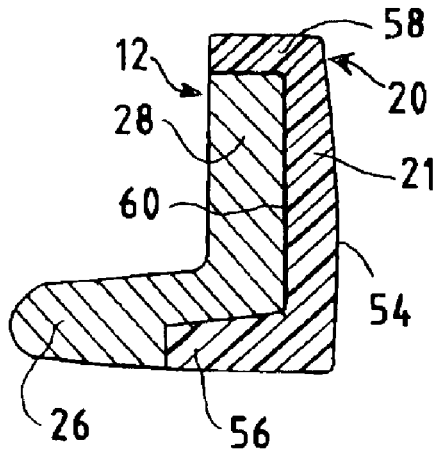
FIG. 8 is a sectional view taken on line 8—8 of FIG. 2.
Figure 9:
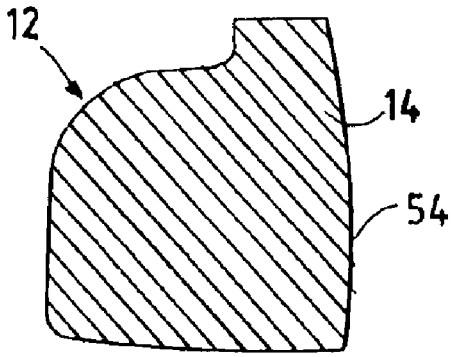
FIG. 9 is a sectional view taken on line 9—9 of FIG. 2.

The transverse internal configuration of clubhead 10 and the internal relationship of the shell 12 and body 20 are best shown in FIGS. 7–9. As shown in FIG. 7, taken on the line 7—7 of FIG. 2, the body 20 is embedded in the shell 12. More specifically, the striking plate 21 is secured against the upright web 28 of shell 12, the upper portion 58 extends beyond the forward surface 60 of web 28 and is secured against the web. The lower or sole portion 56 engages the bottom of web 28 and extends under the shell shelf 26. The hatching of FIGS. 7–9 is intended to indicate that the body 20 is of a low mass density material such as a graphite and resin composite or a fiberglass and resin composite. The shell 12 is of a high mass density material such as stainless steel. FIG. 8 shows the shell 12 and body 20 in cross section at line 8—8 of FIG. 3. FIG. 8 illustrates the shape of the upper portion 58 of body 20 at longitudinal locations displaced from the clubhead center. FIG. 9 shows the polar mass concentration at the toe end of the clubhead in a section taken at line 9—9 of FIG. 3. In manufacture, the shell 20 is formed in a preliminary operation, as is the assembly of the body and hosel. In a final step of manufacture, the two components are secured together. In one embodiment that final step utilizes cement such as the well-known two part epoxy and transverse compression.

The combined body and hosel assembly 61 for the embodiment of FIGS. 1–6 is shown in FIGS. 10–16. The configuration of the assembly 61 with the armature post 39 extending from the hosel facilitates fabrication. In injection molding the assembly 61 the armature 38 is locked within the cavity of the mold prior to molding. The armature post 39 is locked between parts of the mold to properly position the rest of the armature in the body/hosel assembly 61 at the time of formation. The armature post 39 is shown as a smooth cylinder with a flat 80 or other reference preferably provided to insure proper orientation. At the time molding occurs the low mass density material such as a graphite/resin composite is forced into the mold to form the body/hosel assembly 61.

Figure 10:
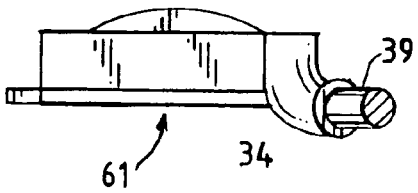
FIG. 10 is top view of a combined body and hosel of the clubhead of FIGS. 1–6.
Figure 11:
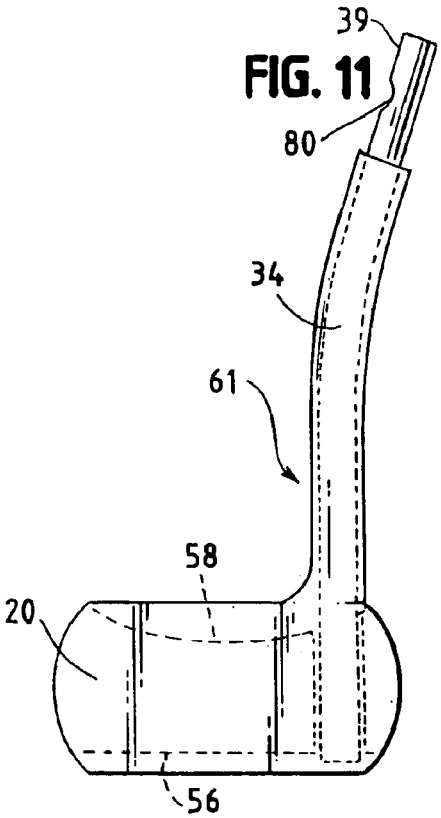
FIG. 11 is a front elevation of the combined body and hosel shown in FIGS. 1–6.
Figure 12:
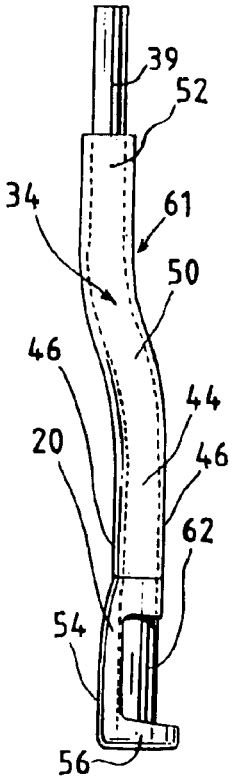
FIG. 12 is a toe end elevation of the combined body and hosel of FIG. 11.

FIG. 10 shows the details of the assembly 61 from above while FIG. 11 is a rear view showing the internal construction in broken lines. FIG. 12 is a view from the heel end and shows the shape of the body 20 and its relationship to the hosel 34, the armature 38 and the thin layer of body material 62 on the armature between the body sole portion 56 and the body upper portion 58. As mentioned in [0052] this configuration is important in the manufacturing method of this invention.

Figure 13:
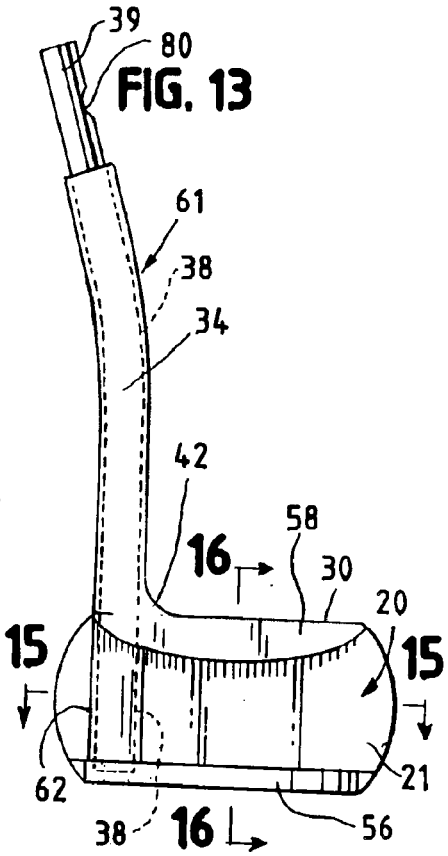
FIG. 13 is a rear elevation of the combined body and hosel of FIG. 11.
Figure 14:
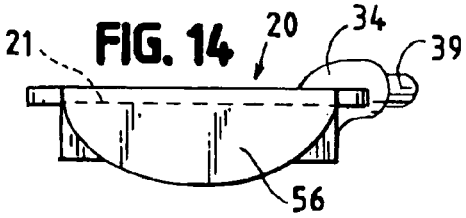
FIG. 14 is a bottom view of the combined body and hosel of FIG. 11.
Figure 15:
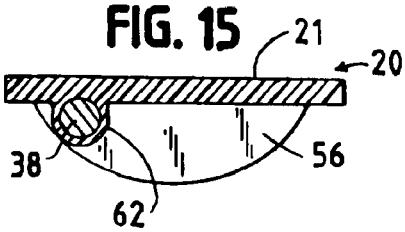
FIG. 15 is a view, in section, of the body taken on the line 15—15 of FIG. 13.
Figure 16:
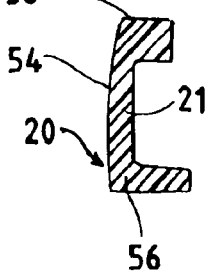
FIG. 16 is a view, in section, of the body taken on the line 16—16 of FIG. 13.
Figure 17:
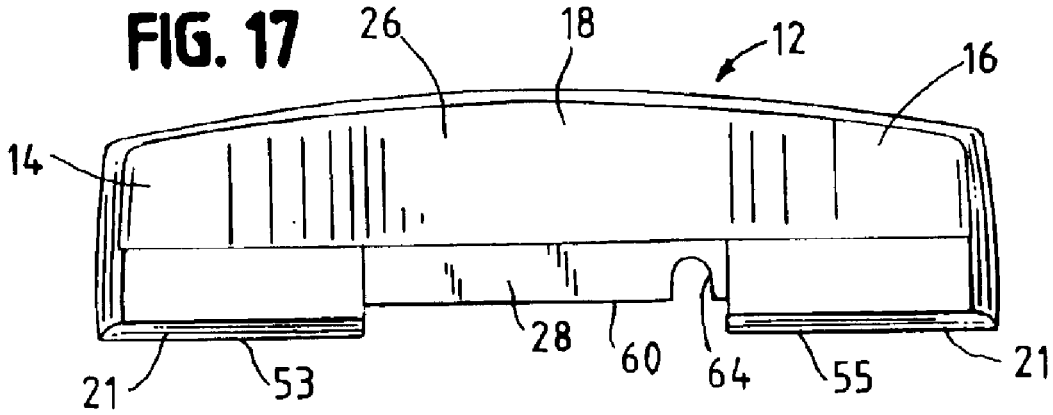
FIG. 17 is a top view of the shell shown in FIGS. 1–6.
Figure 18:
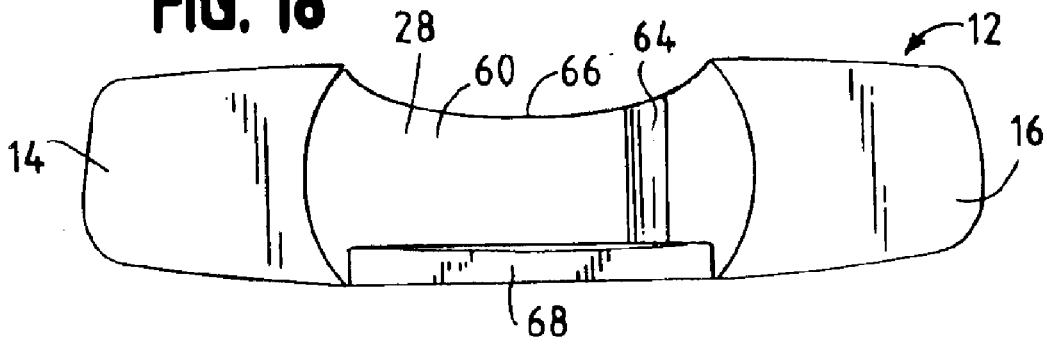
FIG. 18 is front elevation of the shell of FIG. 17.
Figure 19:
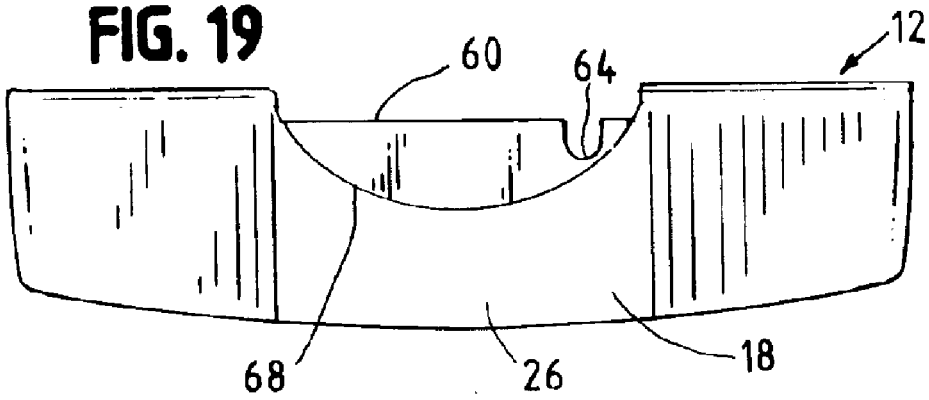
FIG. 19 is a bottom view of the shell of FIG. 17.
Figure 20:
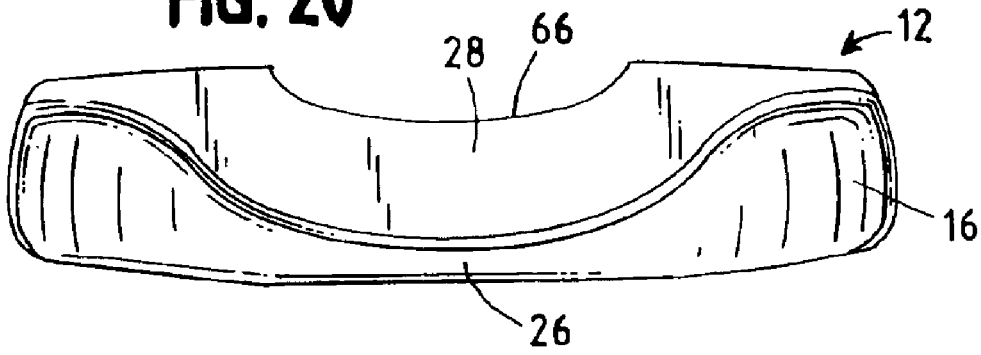
FIG. 20 is a rear elevation of the shell of FIG. 17.

Referring to the rear elevation of assembly 61, FIG. 13, the armature 38 is shown in broken lines within the hosel 34 and the armature post 39 is shown extending above the hosel. The hosel 34 extends upwardly from the upper surface 30 of body 20. Below the hosel 34 the armature 38 extends through the upper portion 58, along the striking plate 21 and into the sole portion 56 of body 20. As already described, the striking plate 21 has circular ends generally centered on the target area 48 shown in FIG. 4. FIG. 16 is a sectional view taken on line 6—16 of FIG. 13 and shows the striking plate 21 of body 20 and sole portion 56 and upper portion 58 extending rearwardly therefrom. As shown in FIG. 15 the armature 38 is approximately tangent to the rear surface of the striking plate 21 and a thin layer or cladding 62 of the low mass density material of the body 20 preferably surrounds the armature. The specific body configuration will be addressed further in describing the shell as shown in FIGS. 17–20. FIG. 16 shows the cross section of the body along the line 16—16 of FIG. 13. The relationship of the upper portion 58, sole portion 56 and striking plate 21 relative to the shell web 28 are also shown assembled with shell 12 in FIG. 7.

Referring now to FIGS. 17–20 the shell 12 can be seen from four perspectives. The shell 12 is fabricated from a relatively high mass density material, preferably metal. A preferred metal is stainless steel, although bronze, brass or composites having a substantial high mass density metal particle content can be employed. In these figures, polar toe portion 14 is on the left and polar heel portion 16 on the right. The medial portion 18 has a forward surface 60 that defines a cavity behind the shell toe surface 53 and heel surface 55 that align with striking surface 54 of body 20. The medial portion 18 also has a shelf 26 extending rearwardly from the forward web 28 and a cutaway 66 in the forward web 28 to accommodate the upper portion 58 of the body 20. A sole cutaway 68 at the bottom of the medial portion 18 accommodates the sole portion 56 of the body 20. The bottom or sole surface of shelf 26 is generally planar and defines the sole plane. The bottom of sole portion 56 is similarly planar and aligned with the sole surface of shelf 26. The bottom of the toe portion 14 and heel portion 16 of shell 12 slope upwardly above the sole plane. Medial web 28 is received between the body sole portion 56 and upper portion 58 in final assembly.

Web 28 has a vertical, partially cylindrical recess 64 that has dimensions appropriate to receive armature 38 in a final assembly step of this invention. The diameter of recess 64 is slightly greater than the diameter of armature 38. As both are metallic or of similar rigid material and have manufacturing tolerances that must be accommodated, a difference in diameter is desirable and a difference of about 0.01 inch will be adequate. The cladding 62 of body material and the cement or adhesive utilized in the final assembly will insure a positive connection. In the preferred method of manufacture appropriate cement such as two-part epoxy is applied to the mating surfaces of the body 20 and shell 12. The two components, the shell and the body/hosel assembly are horizontally aligned in an appropriate press, spaced apart. The spacing is to permit relative motion of the shell and body/hosel parallel to the plane of the sole to provide engagement of the two mating surfaces and to insure precise alignment, intimate contact, compression and adhesion.

Figure 21:
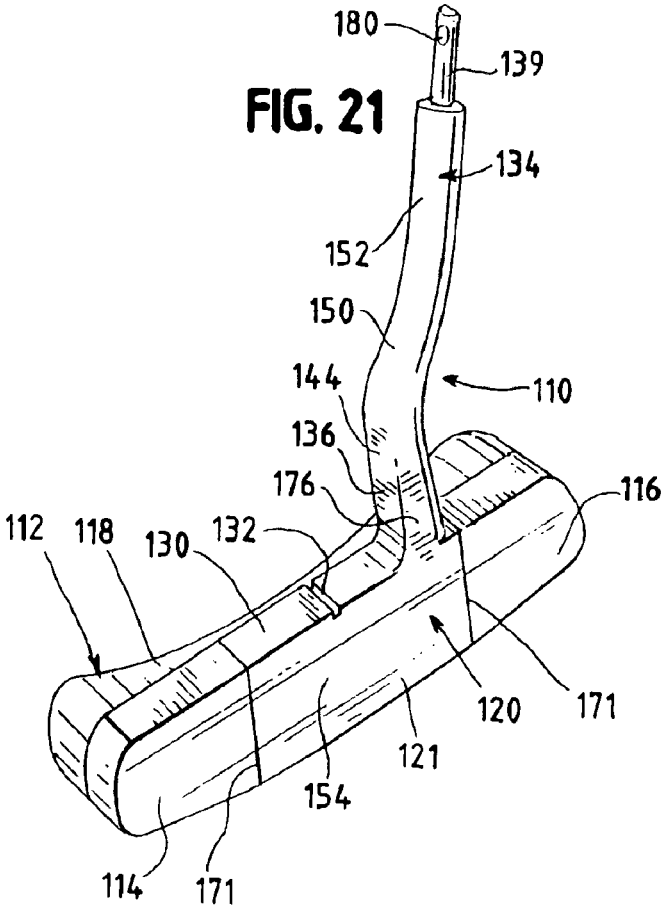
FIG. 21 is a front perspective view of the clubhead of an alternate embodiment.
Figure 22:
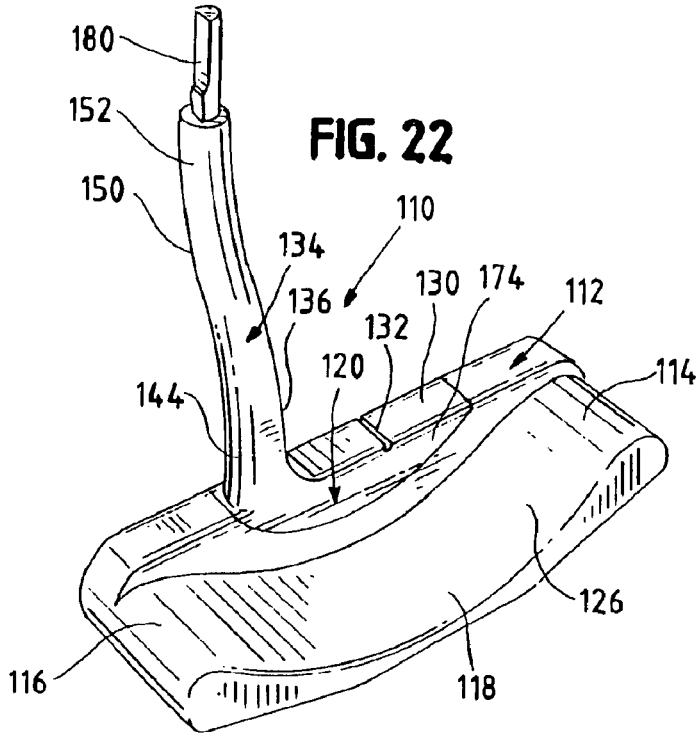
FIG. 22 is a rear perspective view of the embodiment of FIG. 21.

A second embodiment of the invention is shown in FIGS. 21–30 that, in many respects, is similar to the embodiment of FIGS. 1–20. As shown in FIGS. 21–22 the clubhead 110 has a shell 112 and a combined body and hosel 120. The shell 112 has polar toe portion 114, heel portion 116 and medial portion 118 configured as described with respect to the first embodiment but differing in its relationship to the body 120.

The structure and design of the embodiment of FIGS. 1–20 facilitates assembly of the shell and body/hosel unit involving the application of an appropriate cement to the interfaces and joining the two components together in a linear horizontal motion as explained in paragraph [0057]. That is, a motion parallel to the plane of the sole of the clubhead.

In contrast, the putter embodiment of FIGS. 21–30 utilizes a method of manufacture involving a shell and a body/hosel unit that are designed and configured for vertical assembly. In assembling the components in accordance with this embodiment appropriate cement is applied to the interfacing surfaces and the two components are brought together by linear vertical motion, that is motion normal to the sole surface. These assembly steps will be performed in an appropriate jig and press that will bring the components together and apply pressure therebetween as required for a permanent bond.

As seen in FIG. 21 body 120 has a striking plate 121 that defines the clubhead striking surface 154. The striking plate 121 is forward of and extends downwardly from an upper body portion 158 as best shown in FIG. 28. The striking surface 154 is curved around a longitudinal axis slightly below the target spot to provide a slight loft to the ball upon impact as described above at [0050].

FIG. 22 is a backside perspective view and FIG. 27 is a rear elevation of the clubhead of FIG. 21 showing the rearwardly extending median shelf 126 and the polar masses 114 and 116. A rear portion 174 of body 120 extends downwardly from the upper body portion 158 as best shown in FIG. 28. The striking plate 121, upper body portion 158 and rear portion 174 define upper surface 130 with alignment indicium 132. Lower section 144, mid section 150 and upper section 152 of hosel 134 have the configurations and functions already described with respect to the first embodiment. The cross section of the hosel 134 is not circular in all sections. In the lower section 144 in particular, there is a flat face 136 facing the toe end of the club. It has been found that the flat face 136 compliments the flat body surface 130 and the target indicium 132 to provide the golfer with improved sighting and confidence with consequent improved performance. The sides 176 of lower hosel portion 144 are also flattened to conform to the forward surface 136.

The body 120 and hosel 134 are formed around an armature that extends upwardly from the shell 112 and forms a post 139 above the hosel. The post serves to integrate the club shaft, which is preferably a resin composite such as a graphite resin composite with the hosel upper portion 152 that is generally of the same material. The post 139 generally has a circular cross section but has flattened faces 180 to orient the armature in the mold when the body and hosel are formed around it.

Figure 23:
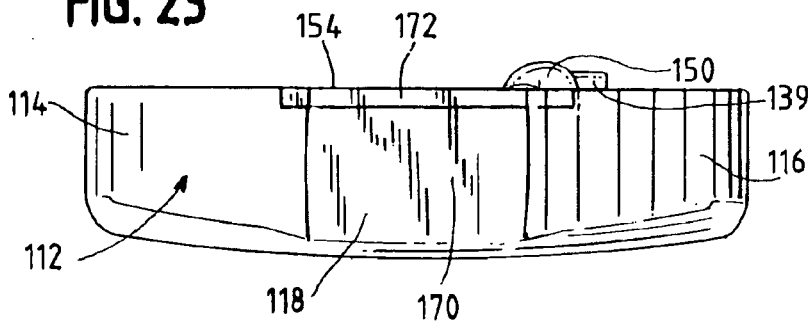
FIG. 23 is a bottom view of the embodiment of FIG. 21.

The striking plate 121 of the body 120 has vertical edges 171 that join matching vertical edges of the shell 112 to accommodate the alternate construction and the vertically oriented method of manufacture. The striking plate 121 extends vertically from the upper surface 130 to a sole surface 172. As shown in FIG. 23, the medial portion 118 of shell 112 and the sole surface 172 of the striking plate 121 define the proximal sole surface 170 of the clubhead. The bottoms of the medial portion 118 and the striking plate 121 define the sole plane while the bottoms of toe portion 114 and heel portion 116 define sole surfaces which slope upwardly from the sole plane. In FIG. 23, the midsection 150 of the hosel and the armature post 139 are shown above heel portion 116.

As shown in the sectional view, FIG. 28 taken on the line 28—28 of FIG. 27, the body 120 has striking plate 121, upper portion 158 and rear portion 174 configured to accommodate vertical assembly. To accommodate the body cross section including rear portion 174, the medial portion 118 of shell 112 has a vertical web comprising forward web 128 and truncated web 178. Thus the body 120 encloses the web on the top, on the striking surface and rear side. The integration of the body, the hosel and the armature is similar to that shown in FIGS. 12, 13 and 15. In this embodiment, there is no sole portion of the body. The body has rear portion 174 that cooperates with the upper portion 158 and striking plate 121 to surround the web 128 and provide the desired responsive relationship therebetween. It appears that this configuration provides the desired sound and feel characteristic of this invention though preferred in some tests. Like the embodiment of FIG. 1, the modular construction of the combined body and hosel and the interface of the body and the shell provide a very efficient method of manufacture. The forming of the shell and the combined body and hosel as relatively small components minimizes the costs of molds and molding and the assembly of the two clubhead components and the shaft can also be done economically with relatively simple clamping and related equipment.

Figure 24:
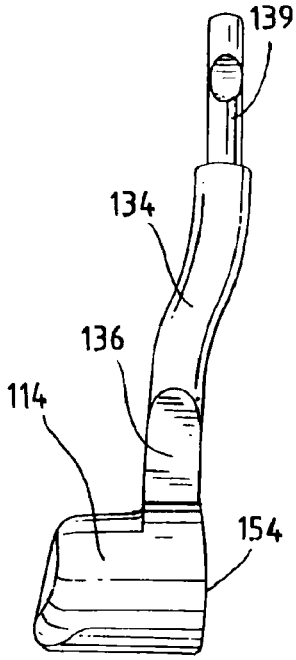
FIG. 24 is a toe end elevation of the embodiment of FIG. 21.
Figure 25:
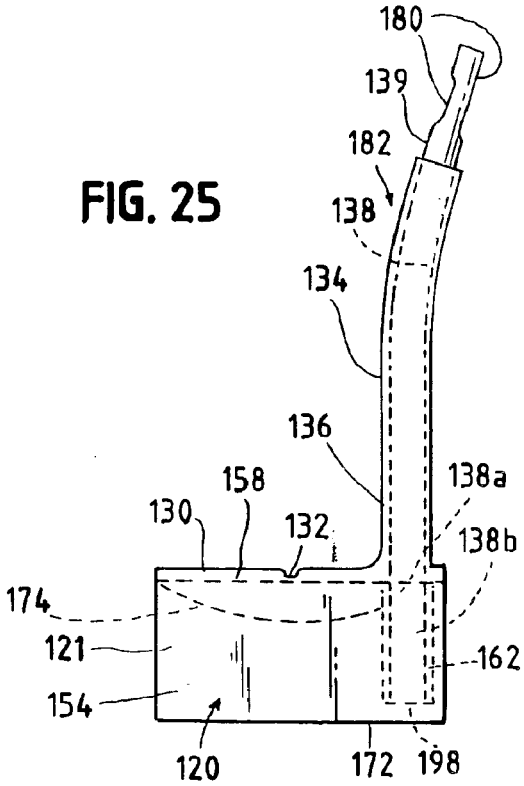
FIG. 25 is a front view of the body/hosel assembly of the FIG. 21 clubhead.

The details of the body/hosel 182 are shown in FIGS. 25 and 30. In FIG. 25 the armature 138 is shown in broken lines within hosel 134. Armature 138 extends up from the top of hosel 134 as post 139 for integration with a shaft such as shaft 40 in FIG. 2. Flats 180 on the post 139 are for positioning the armature 138 a mold when forming the body/hosel 182. The armature 134 also extends down through the upper portion 158 of body 120 that has indicium 132 formed over the target area. The striking plate 121 of body 120 extends down from the front of upper portion 158 defining a striking surface 154 cylindrically curved about a longitudinal axis as shown in FIG. 24. The center of curvature for the striking surface 154 is below an assigned target position on the striking surface 154, thus providing a slight loft as described above. The sole surface 172 of the striking plate 121 extends rearwardly from the bottom edge of surface 154.

The rear portion 174 of body 120 as seen in FIGS. 22 and 27 is shown in broken lines in FIG. 25 extending down from the upper portion 158. The armature portion 138*a* immediately below upper portion 158 is disposed between the striking plate 121 and the rear portion 174. Below the rear portion 174 the armature 138*b* is integrated with the backside of the striking plate 121 and has the surface treatment 162 as described with respect to the first embodiment and shown in FIG. 13. The sole surface 172 and the rear portion 174 of body 120 are shown in the bottom view, FIG. 30. The armature 138 extends downwardly from the upper portion 158 between the striking plate 121 and the rear portion 174. Between the striking plate 121 and rear portion 174 and against striking plate 121 below rear portion 174, the armature 138 is clad in body material 162 and formed against the inside surface of striking plate 121. The armature does not extend down to the striking plate sole 172. Clearance 198 is allowed below armature 138 that will be occupied by a portion of shell 112. This configuration provides the desired sole appearance as seen in the bottom view of the clubhead in FIG. 23.

FIG. 30 shows the sole surface 172 of striking plate 121 at the top. As already described, the striking plate 121 has a curvature or roll and that is a sloping surface in the bottom view appearing as the space 199. Below the space 199 in FIG. 30 is the underside of upper portion 158 of the body and below that is the rear portion 174. The bottom of armature 138 with the thin layer 162 of body material is shown around the armature 138 joined with the backside of striking plate 121.

Figure 26:
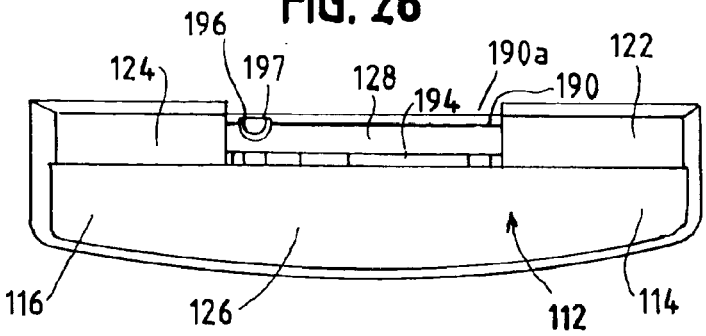
FIG. 26 is a top view of the shell of the clubhead of FIG. 21.

FIGS. 26 and 29 show the top view and front view respectively of the shell 112. In the top view, FIG. 26, medial shelf portion 126 is between the polar toe mass 114 and heel mass 116. The web 128 of medial portion 118 allocated to receive the body 120 is aligned with the toe blade portion 122 and the heel blade portion 124. The medial portion has a cut away 190 to accommodate the body striking plate 121 (FIG. 26) and a cut away 192 to accommodate the body upper portion 158 (FIG. 29). A recess 194 shown as a curved broken line in FIG. 29 will accommodate the body rear portion 174. As already described with respect to the first embodiment, a vertical recess 196 is provided in the forward web 128 of the shell 112 to receive the clad armature 138. The dimensions of the recess 196 and the clad armature 138 are selected in recognition of tolerances to insure that the armature can be received in the recess when practicing the methods of this invention. The recess terminates above the sole surface 170 leaving shell portion 197. Steps in the method include cladding the parts with appropriate cement, appropriately positioning the parts in assembly apparatus or the like with the shell disposed beneath the body/hosel, bringing the parts together and compressing to insure a satisfactory bond.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments might become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A golf clubhead having a heel, a toe, a sole and a top and a striking face between said sole and said top, said clubhead comprising:

a shell having a longitudinally aligned heel section, toe section and medial section, said heel section and toe section defining respective heel and toe surfaces of said sole, said top and said striking face, said medial section having a forward surface spaced rearwardly of said striking face to define an open cavity and having a recess in said forward surface, the material and shape of said heel section and said toe section being selected to provide mass concentration at the heel and at the toe of said clubhead;

a combined elongate body and hosel formed of relatively low mass density material, said body filling said cavity and having an upper portion extending rearwardly of said forward surface and longitudinally located between said heel and toe sections, said body having a top surface as part of said top and a striking surface extending downwardly from said top surface to said sole as a part of said striking face, said hosel extending upwardly from said upper surface above said striking surface; and, an armature disposed within said hosel extending through said upper portion and secured to said body and in said recess.

2. The golf clubhead of claim 1 wherein said combined body and hosel is formed as a single piece.

3. The golf clubhead of claim 2 wherein said striking face is a segment of a longitudinal cylindrical surface having a curved cross section.

4. The golf clubbead of claim 2 wherein said medial section defines a medial sole surface rearwardly of said body.

5. The golf clubhead of claim 1 wherein the combined body and hosel is formed of composite material including graphite fibers and resin.

6. The golf clubhead of claim 1 wherein said combined body and hosel is formed of composite material including glass fibers and resin.

7. A golf clubhead having a heel, a toe, a sole and a top and a striking face between said sole and said top, said clubhead comprising:

a shell having a longitudinally aligned heel section, toe section and medial section, said heel section and toe section defining respective heel and toe surfaces of said sole, said top and said striking face, said medial section having a forward surface spaced rearwardly of said striking face to define an open cavity and having a recess in said forward surface, the material and shape of said heel section and said toe section being selected to provide mass concentration at the heel and at the toe of said clubhead;

a combined elongate body and hosel formed of relatively low mass density material, said body filling said cavity and having an upper portion and a lower portion extending rearwardly of said forward surface and longitudinally located between said heel and toe sections, said body having a top surface as part of said top, a striking surface extending downwardly from said top surface as a part of said striking face and a sole surface as part of said sole, said hosel extending upwardly from said upper surface above said striking surface; and, an armature disposed within said hosel and extending through said upper portion and into said lower portion, and secured to said body and in said recess.

8. The golf clubhead of claim 7 wherein said combined body and hosel is formed as a single piece.

9. The golf clubhead of claim 8 wherein said striking face is a segment of a longitudinal cylindrical surface having a curved cross section.

10. The golf clubhead of claim 8 wherein said medial section defines a medial sole surface rearwardly of said body lower portion.

11. The golf clubhead of claim 8 wherein said medial section defines an upper surface rearwardly of and below said body top surface.

12. The golf clubhead of claim 8 wherein said medial section defines an upper surface rearwardly of and below said body top surface and a medial sole surface rearwardly of said body lower portion.

13. The golf clubhead of claim 8 incorporated with a golf club shaft having a clubhead end wherein said armature extends above said hosel into said clubhead end.

14. The golf clubhead of claim 7 wherein the combined body and hosel is formed of composite material including graphite fibers and resin.

15. The golf clubhead of claim 7 wherein said combined body and hosel is formed of composite material including glass fibers and resin.

16. A golf club comprising:

a shaft having a player gripping end and a clubhead end; and a clubhead having a heel, a toe, a sole and a top and a striking face between said sole and said top and extending from the clubhead end of said shaft, said clubhead including:

a shell having a longitudinally aligned heel section, toe section and medial section, said heel section and toe section defining respective heel and toe surfaces of said sole, said top and said striking face, said medial section having a forward surface spaced rearwardly of said striking face to define an open cavity and having a recess in said forward surface, the material and shape of said heel section and said toe section being selected to provide mass concentration at the heel and at the toe of said clubhead;

a combined elongate body and hosel formed of relatively low mass density material, said body filling said cavity and having an upper portion and a lower portion extending rearwardly of said forward surface and longitudinally located between said heel and toe sections, said body having a top surface as a part of said top, a striking surface extending downwardly from said upper surface to said sole as part of said striking face and a sole surface as a part of said sole, said hosel extending upwardly from said upper surface above said striking surface and incorporated with the clubhead end of said shaft; and an armature disposed within said hosel, secured in said recess and to said body extending through said upper portion and into said lower portion.

17. A golf club according to claim 16 wherein said armature extends above said hosel and into said golf club end of said shaft.

18. A golf club according to claim 17 wherein said combined body and hosel is formed as a single piece.

19. A golf club according to claim 18 wherein said combined body and hosel is formed of composite material including graphite fibers and resin.

20. A golf club according to claim 18 wherein said combined body and hosel is formed of composite material including glass fibers and resin.

21. A golf club according to claim 18 wherein said striking face is a segment of a longitudinal cylindrical surface having a curved cross section.

22. A golf club according to claim 18 wherein said medial section defines a medial sole surface rearwardly of said body sole surface.

23. A golf club according to claim 18 wherein said medial section defines an upper surface rearwardly of and below said body top surface and a medial sole surface rearwardly of said body sole surface.

24. A golf club according to claim 18 wherein said combined body and hosel and said shaft are formed of the same non-metallic material and integrated around said armature.

25. A golf clubhead having a heel, a toe, a sole and a top and a striking face between said sole and said top, said clubhead comprising:

a shell having a longitudinally aligned heel section, toe section and medial section, said heel section and toe section defining respective heel and toe surfaces of said sole, said top and said striking face, said medial section having an upright web defining a forward surface spaced rearwardly of said striking face to define an open cavity and having a recess in said forward surface, the material and shape of said heel section and said toe section being selected to provide mass concentration at the heel and at the toe of said clubhead;

a combined elongate body and hosel formed of relatively low mass density material, said body filling said cavity, having an upper portion extending rearwardly of said forward surface and longitudinally located between said heel and toe sections and having a rear portion extending downwardly from said upper portion and behind said web, said body having a top surface as part of said top and a striking surface extending downwardly from said top surface as a part of said striking face, said hosel extending upwardly from said upper surface above said striking surface; and, an armature disposed within said hosel, extending through said upper portion and secured to said body and in said recess.

26. The golf clubhead of claim 25 wherein said combined body and hosel is formed as a single piece.

27. The golf clubhead of claim 26 wherein said striking face is a segment of a longitudinal cylindrical surface having a curved cross section.

28. The golf clubhead of claim 26 wherein said medial section defines a medial sole surface.

29. The golf clubhead of claim 25 wherein the combined body and hosel is formed of composite material including graphite fibers and resin.

30. The golf clubhead of claim 25 wherein said combined body and hosel is formed of composite material including glass fibers and resin.

31. A method of manufacturing a golf clubhead having a heel, a toe, a sole, a top and a striking face between said sole and said top, the method comprising:

forming a shell of a relatively high mass density material having a longitudinally aligned heel section, toe section and medial section, said heel section and toe section defining respective heel and toe surfaces of said sole, said top and said striking face, said medial section having a forward surface spaced rearwardly of said striking face to define an open cavity and having a recess in said forward surface, the material and shape of said heel section and said toe section being selected to provide mass concentration at the heel and at the toe of said clubhead;

providing an armature;

forming a combined body and hosel of a relatively low mass density material, said body having a striking face portion configured to fill said cavity and having an upper portion configured to extend rearwardly of said forward surface and longitudinally between said heel and toe sections, said body having a top surface as part of said top, a striking surface extending downwardly from said top surface as a part of said striking face and a sole surface as part of said sole, said hosel extending upwardly from said top body surface and said armature incorporated within said hosel, extending through said upper portion and secured to said striking face portion to align with said recess;

applying a cement to appropriate surfaces of said shell and combined body and hosel that are to be engaged;

assembling said body in said cavity with said armature in said recess; and applying pressure between the body and the shell to form a bond therebetween.

32. The method of claim 31 wherein the cement is a two part epoxy resin.

33. The method of claim 31 wherein said recess is configured to provide a gap to accommodate tolerances between said recess and said armature and for cement retention.

34. The method of claim 31 wherein said high mass density material is metallic.

35. The method of claim 31 wherein said low mass density material is a composite carbon and resin material.

36. The method of claim 31 wherein said armature extends upwardly from said hosel to support a club handle.

37. The method of claim 36 including the additional steps of:

providing a hollow shaft of a composite carbon and resin material; and, integrating said shaft with the hosel and surrounding the exposed portion of said armature.

38. A method of manufacturing a golf clubbead having a heel, a toe, a sole, a top and a striking face between said sole and said top, the method comprising:

forming a shell of a relatively high mass density material having a longitudinally aligned heel section, toe section and medial section, said heel section and toe section defining respective heel and toe surfaces of said sole, said top and said striking face, said medial section having a forward surface spaced rearwardly of said striking face to define an open cavity and having a recess in said forward surface, the material and shape of said heel section and said toe section being selected to provide mass concentration at the heel and at the toe of said clubhead;

providing an armature;

forming a combined body and hosel of a relatively low mass density material, said body having a striking face portion configured to fill said cavity and having an upper portion and a sole portion configured to extend rearwardly of said forward surface and longitudinally between said heel and toe sections, said body having a top surface as part of said top, a striking surface extending downwardly from said top surface as a part of said striking face and a sole surface as part of said sole, said hosel extending upwardly from said top body surface and said armature incorporated within said hosel, extending through said upper portion and into said sole portion and secured to said striking face portion to align with said recess;

applying a cement to appropriate surfaces of said shell and combined body and hosel that are to be engaged;

assembling said body in said cavity with said armature in said recess; and applying pressure between the body and the shell to form a bond therebetween.

39. A method of manufacturing a golf clubhead having a heel, a toe, a sole, a top and a striking face between said sole and said top, the method comprising:

forming a shell of a relatively high mass density material having a longitudinally aligned heel section, toe section and medial section, said heel section and toe section defining respective heel and toe surfaces of said sole, said top and said striking face, said medial section having an upright web defining a forward surface spaced rearwardly of said striking face to define an open cavity and having a recess in said forward surface, the material and shape of said heel section and said toe section being selected to provide mass concentration at the heel and at the toe of said clubhead;

providing an armature;

forming a combined body and hosel of a relatively low mass density material, said body having a striking face portion configured to fill said cavity and having an upper portion configured to extend rearwardly of said forward surface and extending longitudinally between said heel and toe sections and a rearward portion extending downwardly from said upper portion behind said web, said body having a top surface as part of said top and a striking surface extending downwardly from said top surface to said sole as a part of said striking face, said hosel extending upwardly from said top body surface and said armature incorporated within said hosel, extending through said upper portion and secured to said striking face portion to align with said recess;

applying a cement to appropriate surfaces of said shell and combined body and hosel that are to be engaged;

assembling said body in said cavity with said armature in said recess; and applying pressure between the body and the shell to form a bond therebetween.

* * * * *

UNITED STATES PATENT AND TRADEMARK OFFICE

CERTIFICATE OF CORRECTION

PATENT NO. : 6,860,820 B2
DATED : March 1, 2005
INVENTOR(S) : Paul Specht

It is certified that error appears in the above-identified patent and that said Letters Patent is hereby corrected as shown below:

Column 5,
Line 21, delete “putterf” and insert -- putter --

Column 6,
Line 29, delete “in [0052]” and insert -- at column. 6, lines 3-6 --
Line 41, delete “line 6-16” and insert -- line 16-16 --

Column 7,
Line 39, delete “[0057]” and insert -- column 7, lines 19-25 --
Line 59, delete “[0050]” and insert -- column 5, lines 40-44 --

Signed and Sealed this

Fifth Day of July, 2005

JON W. DUDAS
*Director of the United States Patent and Trademark Office*